United States Patent [19]

Miller

[11] Patent Number: 4,771,672

[45] Date of Patent: Sep. 20, 1988

[54] EASILY OPENABLE GUN PORT ASSEMBLY

[75] Inventor: Robert L. Miller, Hacienda Heights, Calif.

[73] Assignee: Armored Transport, Inc., Los Angeles, Calif.

[21] Appl. No.: 23,664

[22] Filed: Mar. 9, 1987

[51] Int. Cl.[4] ..... F41H 5/26

[52] U.S. Cl. ..... 89/36.14; 292/228; 292/DIG. 46

[58] Field of Search ..... 89/36.04, 36.07, 36.09, 89/36.14, 40.03; 109/17, 18, 59 R, 64, 73; 49/386, 415, 416, 421, 423; 292/80, 87, 219, 228, DIG. 46

[56] References Cited

U.S. PATENT DOCUMENTS

| | | | |
|---|---|---|---|
| 385,396 | 7/1888 | Workman | 89/36.07 |
| 1,424,048 | 7/1922 | Szalay | 292/228 |
| 1,694,556 | 12/1928 | Neely | 109/17 |
| 1,804,677 | 5/1931 | Davis | 109/17 |
| 2,249,132 | 7/1941 | Haslam | 292/87 |

*Primary Examiner*—Stephen C. Bentley
*Attorney, Agent, or Firm*—William W. Haefliger

[57] ABSTRACT

A gun port assembly includes:

(a) a slidable closure, (b) structure forming a port and carrying the closure for sliding movement into and out of closing relation with the port, (c) a latching shoulder on the structure, (d) a latching lever pivotably carried by the closure and having a first portion engageable with the shoulder in closed position of the closure to block opening movement of the closure, (e) the latching lever having a second portion projecting for displacement by the user to pivot the lever first portion out of engagement with that shoulder and to displace the closure out of closing relation with the port.

7 Claims, 2 Drawing Sheets

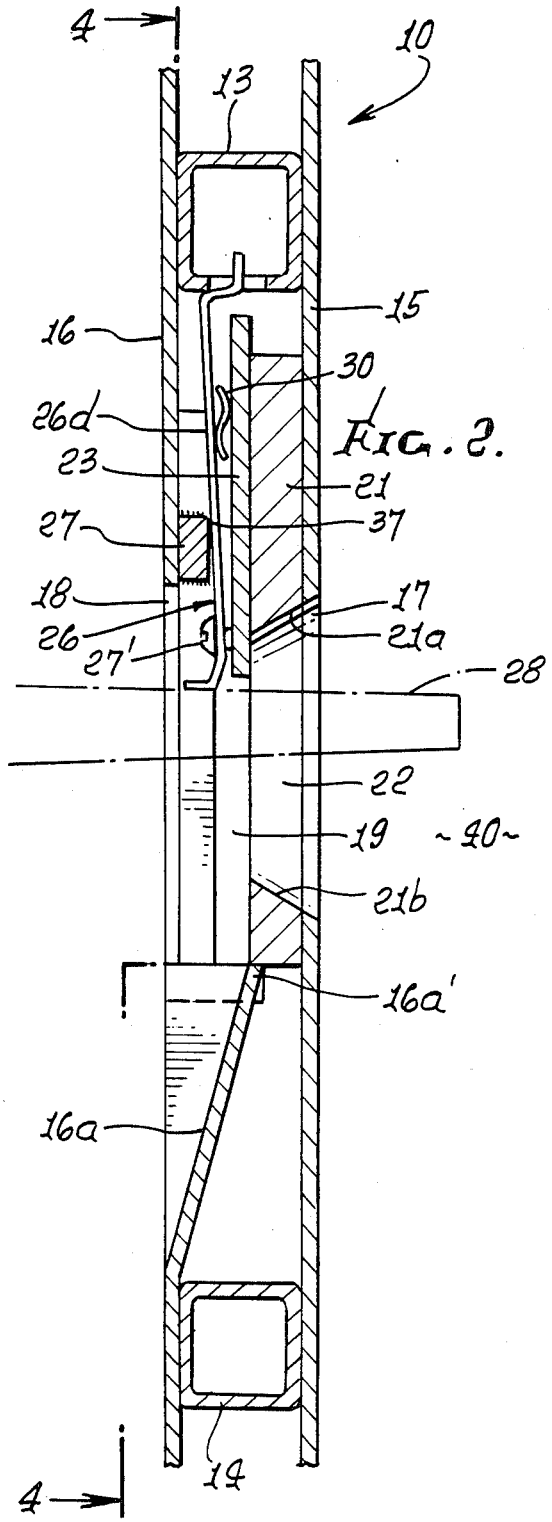
FIG. 2.
FIG. 1.
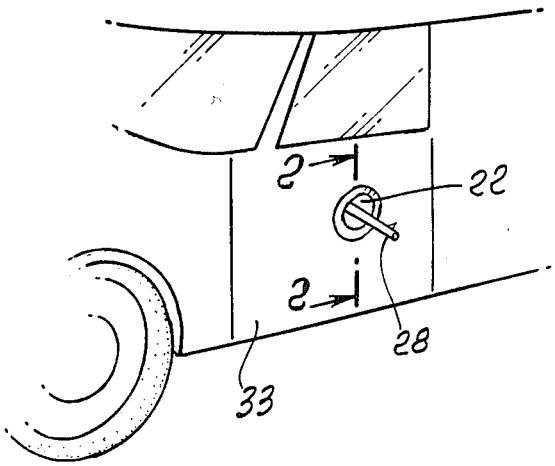
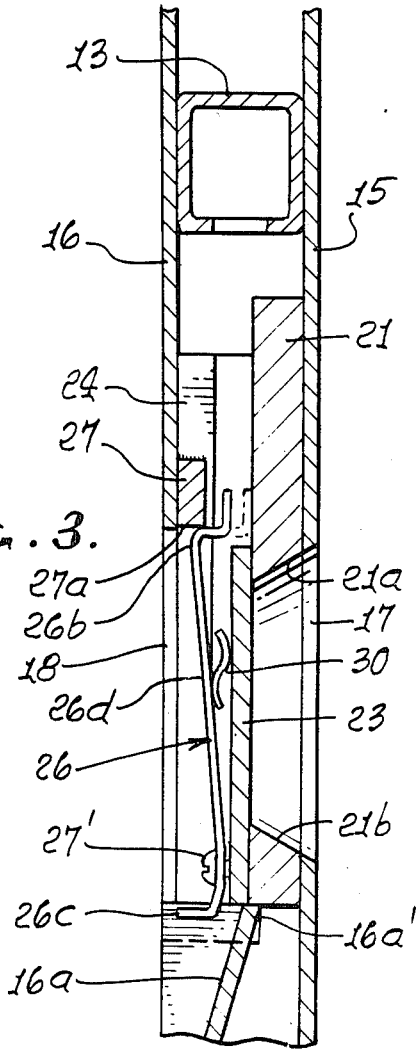
FIG. 3.

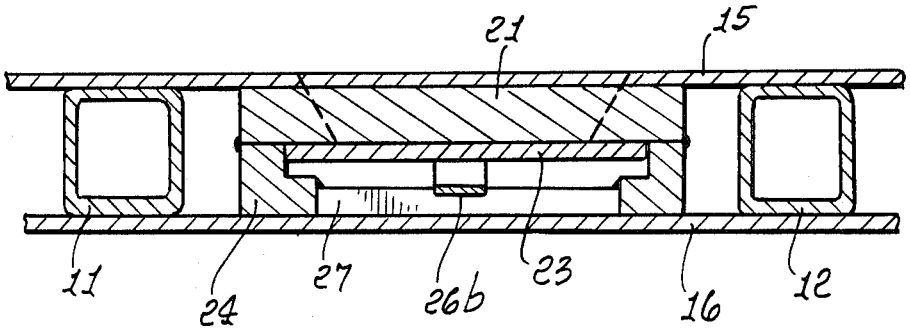
FIG. 5.
FIG. 4.
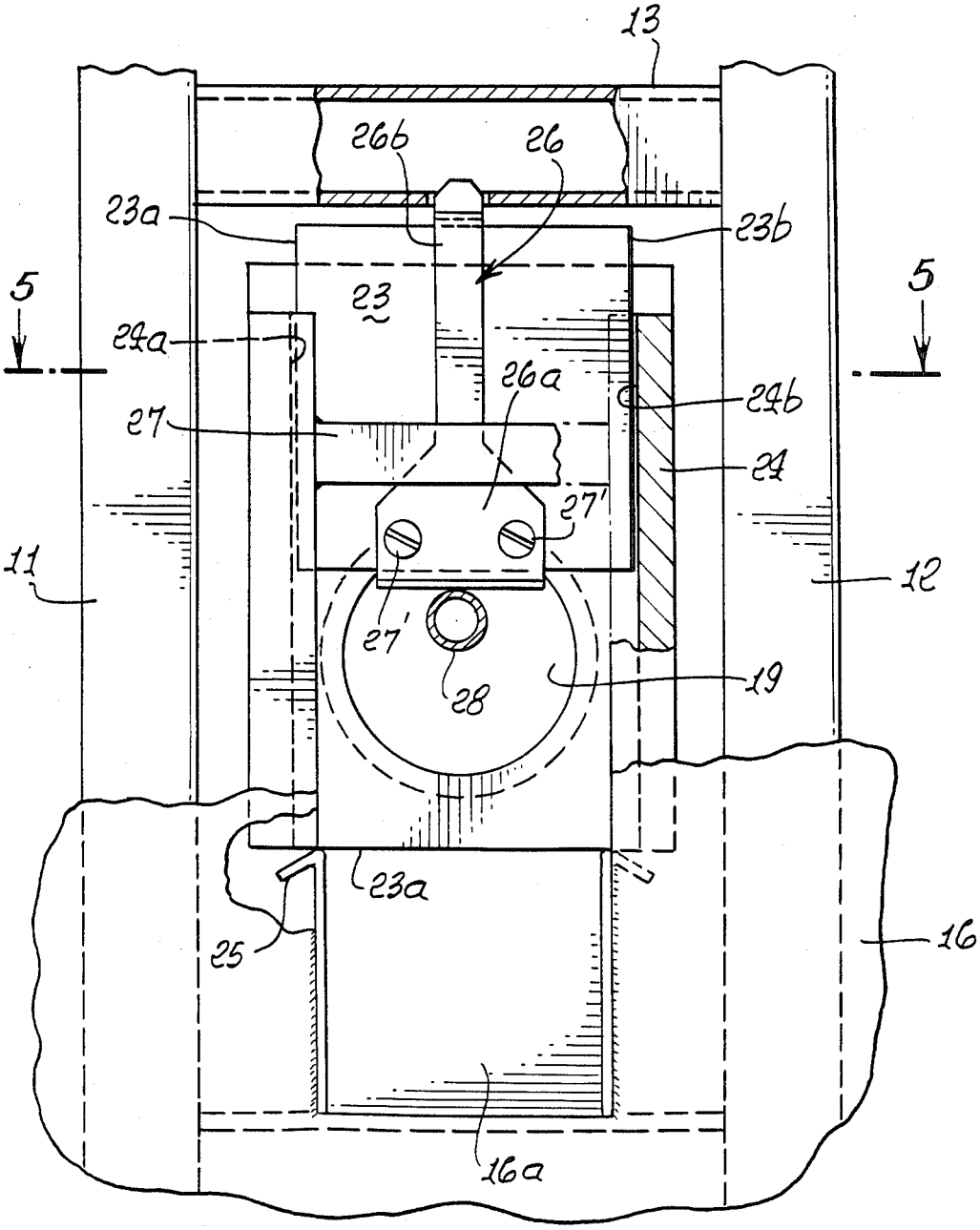

EASILY OPENABLE GUN PORT ASSEMBLY

BACKGROUND OF THE INVENTION

This invention relates generally to gun ports, and more particularly concerns easily and quickly operable gun port apparatus useful in defense of armored vehicles and other installations.

Conventional gun ports have closures that require manual elevation, followed by separate insertion or projection of the gun barrel through the open port. This is time consuming and critical, in that the successful defense of an armored vehicle depends upon speed of firing through the port, to ward off attackers. There is need for means to reduce the time of gun port opening manipulation, so that the risk of unsuccessful defense is reduced. Also, there is need for improved construction of gun port mechanism, and including facilitation of widened angularity of gun aiming or positioning, in the port.

SUMMARY OF THE INVENTION

It is a major object of the invention to provide an improved gun port mechanism or apparatus, meeting the above needs. Basically, the apparatus of the invention includes:

(a) a slidable closure, (b) structure forming a port and carrying the closure for sliding movement into and out of closing relation with the port, (c) a latching shoulder on said structure, (d) a latching lever pivotally carried by the closure and having a first portion engageable with said shoulder in closed position of the closure to block opening movement of the closure, (e) the latching lever having a second portion projecting for displacement by the user to pivot the lever first portion out of engagement with said shoulder and to displace the closure out of closing relation with the port.

As will appear, the structure typically extends upright and carries the closure for up and down sliding movement, the closure having a down position in which said port is closed by the closure; also the lever may extend upright, with its first portion having an upper lip engageable with said shoulder, said lever second portion extending downwardly to terminate at a pusher manually engageable by the user as by the user's gun. A spring may be carried by the closure to bias the lever first portion into latching relation with said shoulder.

A further object is to provide a ramp extending upwardly and inwardly below the level of the closure and toward a plane defined by theclosure which comprises a plate, said pusher located inwardly of the uppermost extent of the ramp, the ramp providing lifting and pushing access to the pusher; and the structure typically defines a wall having inner and outer upright opposite sides, said closure located between upright inner and outer planes defined by said opposite sides, with the ramp extending upwardly and forwardly from the inner wall and toward and beneath the pusher, whereby a gun barrel may, with one upward and forward motion, quickly elevate the port closure and also projects through the opening port. Flaring of the port walls enables wide angled aiming or swiveling of the gun barrel.

These and other objects and advantages of the invention, as well as the details of an illustrative embodiment will be more fully understood from the following specification and drawings, in which:

DRAWING DESCRIPTION

FIG. 1 is a perspective view showing the invention as applied to the door of an armored vehicle;

FIG. 2 is an enlarged elevation taken on lines 2—2 of FIG. 1;

FIG. 3 is a view like FIG. 1, showing the port in closed position;

FIG. 4 is a front elevation on lines 4—4 of FIG. 2;

FIG. 5 is a plan view in section on lines 5—5 of FIG. 4.

DETAILED DESCRIPTION

In the drawings, an armored frame 10 is defined by the two steel uprights 11 and 12 which are laterally spaced apart, a top cross-piece 13 welded to the tops of the uprights, and a bottom cross-piece 14. Front and rear steel plates 15 and 16 attached to the frame provide an armored assembly, the plates containing openings 17 and 18 in registration with port 19 defined by the frame. The members 11–14 may have hollow, rectangular cross-section as shown. A relatively thick plate 21 at the inner side of plate 15 defines an opening 22 in registration with opening 19. Plate 21 also defines inwardly tapering top and bottom walls **21*a* and 21*b*, for drawing moisture toward the outer side 40 of the gun port assembly. Plates 15 and 21** may be suitably connected, as by welding.

A vertically slidable closure plate 23 is provided at the inner side of plate 21, and its lateral edges **23*a* and 23*b* are guided by vertical plates 24*a* and 24*b* defined by guide members 24 supported by the frame to extend upright at laterally opposite sides of the closure plate. Accordingly, closure plate 23 is vertically slidable between a down position as seen in FIG. 3, and an up-position as seen in FIG. 2. In down position, the closure plate bottom edge 23*a* seats on stops 25, the gun ports 19 and 22 being closed with plate 23 extending adjacent the inner side of plate 21; and in up position of plate 23, the ports are open, as seen in FIGS. 2 and 4**.

A latching lever 26 is pivotally carried by the closure plate, as shown. For example, fasteners 27 may be provided to pivotally attach the lower portion **26*a* of the lever to the inner side of the closure plate, whereby the latch lever is pivotable about a fulcrum centrally engaging the lower inner side of plate 23. The axis of lever pivoting extends horizontally and laterally, whereby a second i.e. upper portion 26*b* of the lever is movable rearwardly and forwardly. Thus, in closed position of the closure plate 23, the L-shaped upper (first) portion 26*b* of the lever engages a latching shoulder 27*a* on a cross-piece 27*b*** connected to the uprights to block upward opening displacement of the closure plate.

The lever has a second L-shaped portion **26*c* projecting rearwardly for upward push displacement by the user, i.e. his gun barrel 28 as the barrel is lifted, to pivot the lever clockwise in FIGS. 2 and 3 so that the lever portion 26*b* is pivoted out of engagement with the latch shoulder, allowing lifting of the lever and attached closure plate, by the gun barrel 28, thus, the user need not separately lift the plate, manually, and then insert the gun barrel through the gun ports 19 and 22; i.e. he accomplishes both of these objectives much more quickly merely by inserting the gun barrel under projection or pusher 26*c* and lifting it, while pushing the barrel forwardly, which accomplishes unlatching of the lever as the barrel is lifted, the barrel then quickly passing through the port 19 as soon as the closure is lifted by the barrel sufficiently to allow barrel passage through the port, as seen in FIG. 2**.

A weak spring 30 is shown between the lever and intermediate vertical extent 26*d*, and the closure plate 23, to urge the lever counterclockwise and into latching position, as seen in FIG. 3, as the closure plate is lowered. Note the lever lip at L-shaped portion 26*b*, engaging the latch shoulder 27*a* in FIG. 3.

Also provided is a ramp 16*a* defined by plate structure 16, which extends forwardly and upwardly toward the plane defined by the closure plate 23, and to terminate at 16*a'* just forwardly of the pusher 26*c*. That ramp functions to quickly guide the gun barrel forwardly upwardly and beneath the pusher, i.e. into position to engage the pusher and pivot it to unlatch the lever, all as a result of upward motion of the gun barrel while pressing it forwardly against the ramp so as to quickly pass through the gun port as the gun lifts the clousre plate, via the lever 26.

The easily openable gun port apparatus as described has uses other than on armored vehicles, i.e. as on armored walls of buildings, etc. FIG. 1 shows its application to an armored vehicle door 33.

As shown in FIG. 2, cross-piece 17 engages the lever 26 as it slides up and down, as at location 37.

I claim:

1. In a gun port assembly, the combination comprising:

(a) a slidable closure, (b) structure forming a port and carrying the closure for sliding movement into and out of closing relation with the port, (c) a latching shoulder on said structure, (d) a latching lever pivotally carried by the closure and having a first portion engageable with said shoulder in closed position of the closure to block opening movement of the closure, (e) the latching lever having a second portion projecting for displacement by the user to pivot the lever first portion out of engagement with said shoulder and to displace the closure out of closing relation with the port, (f) said structure extending upright and carrying the closure for up and down sliding movement, the closure having a down position in which said port is closed by the closure, (g) said lever extending generally upright, said lever first portion having an upper lip engageable with said shoulder, said lever second portion extending downwardly to terminate at a pusher manually engageable by the user as by the user's gun, (h) said structure defining a wall having inner and outer upright opposite sides, said closure located between upright inner and outer planes defined by said opposite sides, the lever located at the inner side of the closure, (i) and said structure defining a ramp extending upwardly and outwardly below the level of the closure and toward a plane defined by the closure which comprises a plate, said pusher located inwardly of the uppermost extent of the ramp, the ramp providing lifting and pushing access to the pusher.

2. The combination of claim 1 including a spring carried by the closure to bias the lever first portion into latching relation with said shoulder.

3. The combination of claim 1 wherein said structure defines an outwardly flaring beveled surface about a recess at the immediate outer side of the closure.

4. The combination of claim 1 wherein said structure and said closure consist of steel.

5. The combination of claim 4 wherein said structure defines an armored wall in which said port is formed.

6. The combination of claim 5 including additional wall means carrying said structure.

7. The combination of claim 6 including an armored vehicle defining said wall means.

* * * * *